US006101753A

United States Patent [19]

Shieh

[11] Patent Number: 6,101,753

[45] Date of Patent: Aug. 15, 2000

[54] PHOTO RECEIVING DEVICE

[76] Inventor: Yih-Shan Shieh, No. 11, 52 Alley, Dah An Street, Shih-Jyy Town, Taipei-Hsien, Taiwan

[21] Appl. No.: 09/131,791

[22] Filed: Aug. 10, 1998

[51] Int. Cl.[7] ..... G09F 1/12

[52] U.S. Cl. ..... 40/782; 40/785; 40/790; 40/757

[58] Field of Search ..... 40/757, 759, 768, 40/777, 782, 784, 785, 790, 796, 156; 403/401, 402, 403

[56] References Cited

U.S. PATENT DOCUMENTS

| | | | |
|---|---|---|---|
| 1,168,832 | 1/1916 | Smernoff | 40/737 X |
| 3,665,629 | 5/1972 | Shore | 40/782 X |
| 3,698,114 | 10/1972 | Hirsch et al. | 40/782 |
| 3,736,684 | 6/1973 | Grad | 403/401 X |
| 4,477,990 | 10/1984 | Buchanan | 40/784 |
| 4,538,936 | 9/1985 | Zeidl | 40/782 X |
| 4,738,039 | 4/1988 | Sun et al. | 40/784 |
| 4,903,934 | 2/1990 | Fremstad | 40/757 X |
| 5,071,281 | 12/1991 | Murphy et al. | 403/401 X |

*Primary Examiner*—Brian K. Green
*Attorney, Agent, or Firm*—Rosenberg, Klein & Bilker

[57] ABSTRACT

A photo receiving device includes four side rails with four corner members joining the side rails to form a rectangular frame, each of the side rails having a dove-tailed groove defined therein in which a plurality of pressing members and a hanger are movably and rotatably received. Each of the pressing members and the hanger has an ellipse shank which is sized to be movably received in or securely engaged with the dove-tailed groove by rotation. Each of the side rails has a flange extending from an inner side thereof so as to support a board mounted thereto which is pressed by the pressing members.

6 Claims, 6 Drawing Sheets

PHOTO RECEIVING DEVICE

FIELD OF THE INVENTION

The present invention relates to a receiving device, and more particularly, to a photo receiving device having dove-tailed grooves in which a hanger and pressing members are movably and rotatably received, each of which has an elliptical shank sized to be securely engaged with the groove or freely moved in the groove.

BACKGROUND OF THE INVENTION

A conventional photo receiving device or frame is generally assembled by wooden plates which are connected by nails. However, the nailing could result cracks in the wooden plates or even penetrating through the plates to hurt the hands of users or damage the photo or pictures. In addition, the increasing sense of environment protection makes the manufacturers cannot get timbers easily so that plastic receiving device is developed which is manufactured by way of molding ejection. The plastic receiving device although is cheaper than that of the wooden receiving device, the style thereof is not satisfactorily accepted. Furthermore, the mold for ejecting the receiving device is expensive so that each style of the receiving device needs a specific mold. Each of the photo receiving devices has a hanger attached thereto which is fixedly attached to a rear side of the device and cannot be shifted.

The present invention intends to provide a photo receiving device assembled by four side rails, four comer members, a plurality of pressing members and a hanger wherein each of the side rails has a dove-tailed groove defined therein so that the hanger and the pressing members are movably and rotatably received in the grooves.

The present invention has arisen to mitigate and/or obviate the disadvantage of the conventional photo receiving device.

SUMMARY OF THE INVENTION

In accordance with one aspect of the present invention, there is provided a photo receiving device comprising four side rails 1 each having a dove-tailed groove defined longitudinally therein and a flange extending from an inner side thereof; four corner members each having a first portion and a second portion which extends perpendicularly to the first portion, every two of the adjacent side rails being connected by a corner member and each of the first portion and the second portion being sized to be received in the two adjacent dove-tailed grooves of the two adjacent side rails.

A plurality of pressing members each have an ellipse shank and a pressing portion which extends perpendicularly from the ellipse shank corresponding thereto and presses a board mounted to the four flanges of the four side rails. Each of the ellipse shanks of the pressing members is movably and rotatably received the dove-tailed grooves of the side rails.

A hanger has an ellipse shank and a ring member extending perpendicularly from the ellipse shank thereof. The ellipse shank is movably and rotatably received in either one of the four dove-tailed grooves.

It is an object of the present invention to provide a photo receiving device which has pressing members and a hanger movably and rotatably attached thereto.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
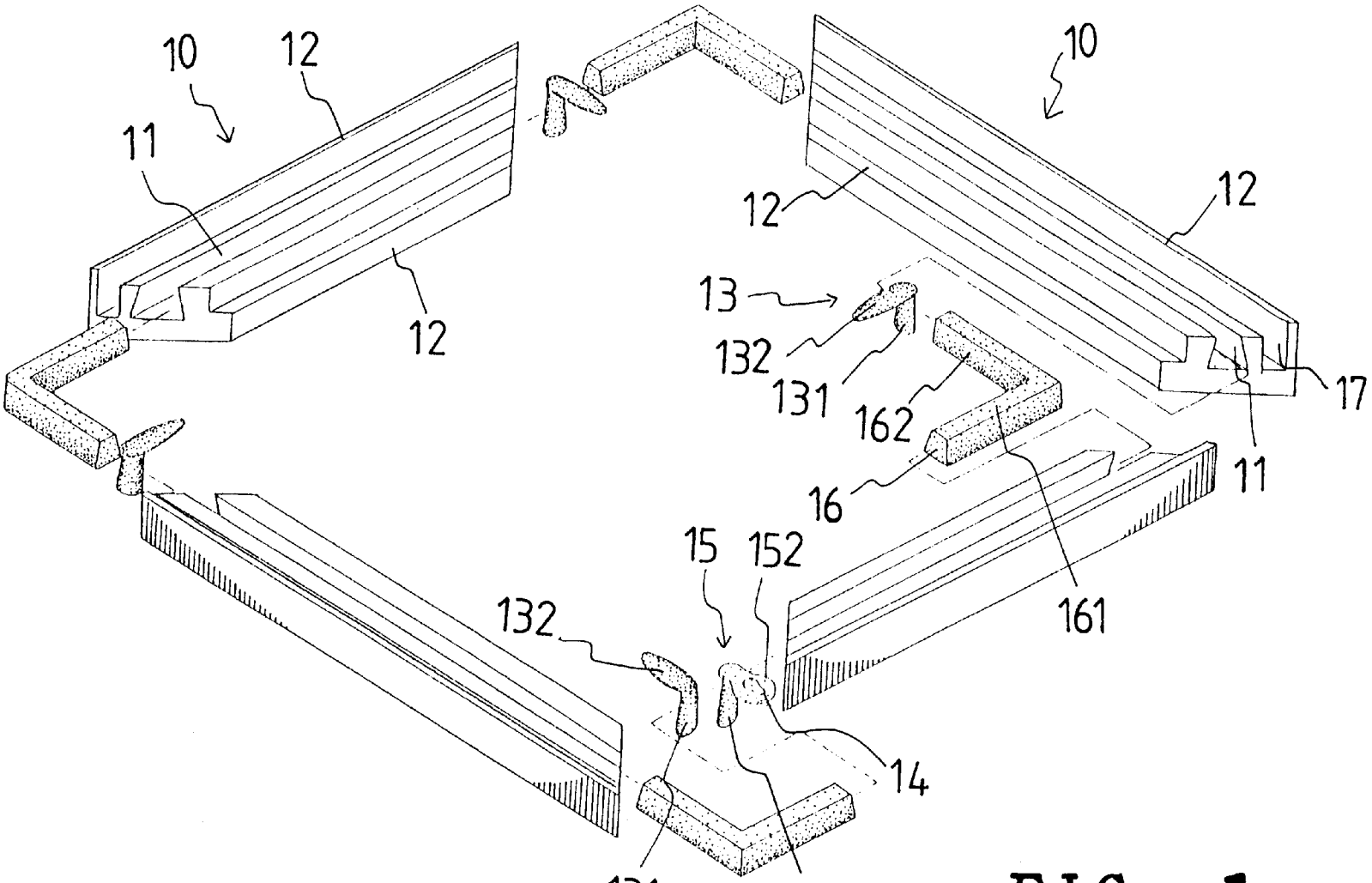
FIG. 1 is an exploded view of a photo receiving device in accordance with the present invention.
Figure 2:
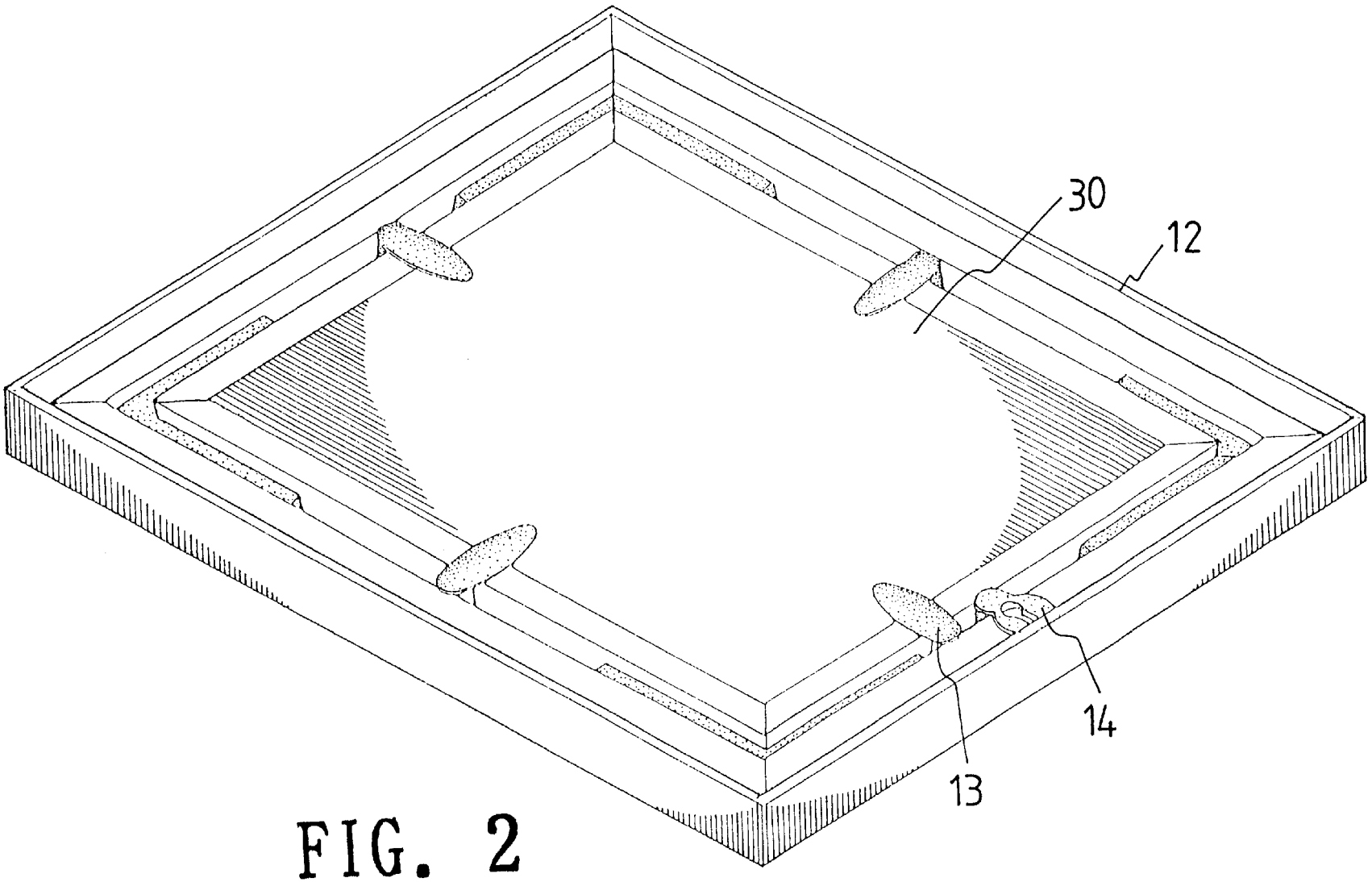
FIG. 2 is a perspective view of the photo receiving device in accordance with the present invention.
Figure 3:
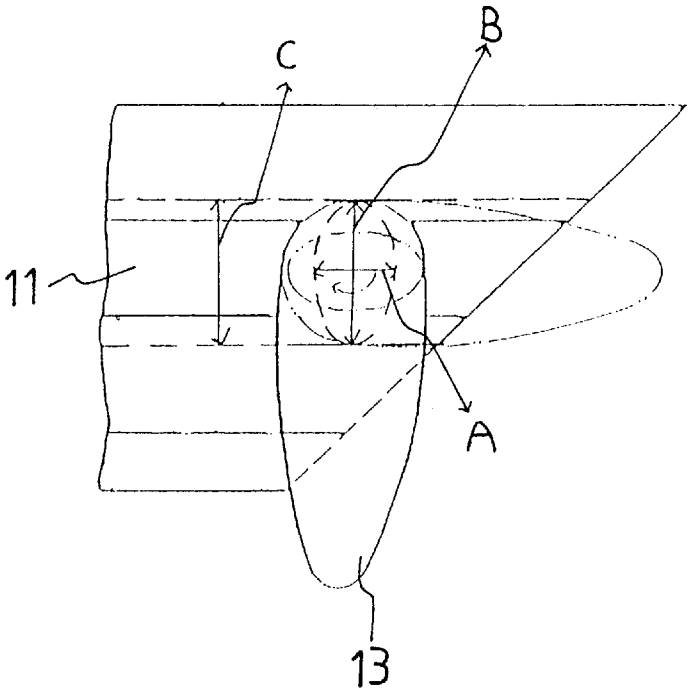
FIG. 3 is an illustrative view to illustrate the engagement of the ellipse shank of the pressing members/hanger and the dove-tailed groove in each of the side rails of the device.

Referring to FIGS. 1 through 3, a photo receiving device of the present invention comprises four side rails 10 each having a dove-tailed groove 11 defined longitudinally therein and a flange 12 extending from an inner side thereof. Each of the side rails 10 further has a passage 17 defined in parallel with the dove-tailed groove 11 corresponding thereto and located in an outer side thereof. Each of the passages 17 is defined by a peripheral side defining the dove-tailed groove 11, an outer wall 12 and a bottom which is connected between the peripheral side and the outer wall 12 which extends perpendicularly to the rail 10 and the flange 12 and beyond the peripheral side defining the dove-tailed groove 11.

Four corner members 16 each have a first portion 161 and a second portion 162 which extends perpendicularly to the first portion 161 of that every two of the adjacent side rails 10 are connected by one of the comer members 16 by inserting the first portion 161 and the second portion 162 into the two adjacent dove-tailed grooves 11 of the two adjacent side rails 10. The first portion 161 and the second portion 162 each have a cross section sized to be fitted into the dove-tailed grooves 11. A plurality of pressing members 13 each have an ellipse shank 131 and a pressing portion 132 which extends perpendicularly from the ellipse shank 131 corresponding thereto. The pressing portions 132 of the pressing members 13 are used to press a board 30 mounted to the four flanges 12 of the four side rails 10 as shown in FIG. 2. Each of the ellipse shanks 131 of the pressing members 13 is movably and rotatably received the dove-tailed grooves 11 of the side rails 10. A hanger 15 has an ellipse shank 151 and a ring member 152 extending perpendicularly from the ellipse shank 151 of the hanger 15. The ring member 152 has a hole 14 defined therethrough and the ellipse shank 151 is movably and rotatably received in either one of the four dove-tailed grooves 11.

It is to be noted that the ellipse shanks 131 of each of the pressing members 13 and the ellipse shank 151 of the hanger 15 each have a short axis "B" which is shorter than a maximum width "C" of each of the dove-tailed grooves 11 and a long axis "A" which is slightly longer than the maximum width "C" of each of the dove-tailed grooves 11. Therefore, when the long axis "A" is arranged in parallel with a longitudinal axis of the dove-tailed groove 11, the hanger 15 and/or the pressing members 13 are freely moved within either one of the dove-tailed grooves 11. When rotating the ellipse shank 131/151 to arrange the long axis "A" to be perpendicular to the longitudinal axis of the dove-tailed groove 11, because the length "A" is slightly larger than the maximum width "C" of the dove-tailed groove 11 so that the pressing members 13 and/or the hanger 15 are securely engaged with the dove-tailed groove 11. Therefore, the pressing members 13 and/or the hanger 15 are able to be conveniently moved to a desired position according to the needs of users.

Figure 8:
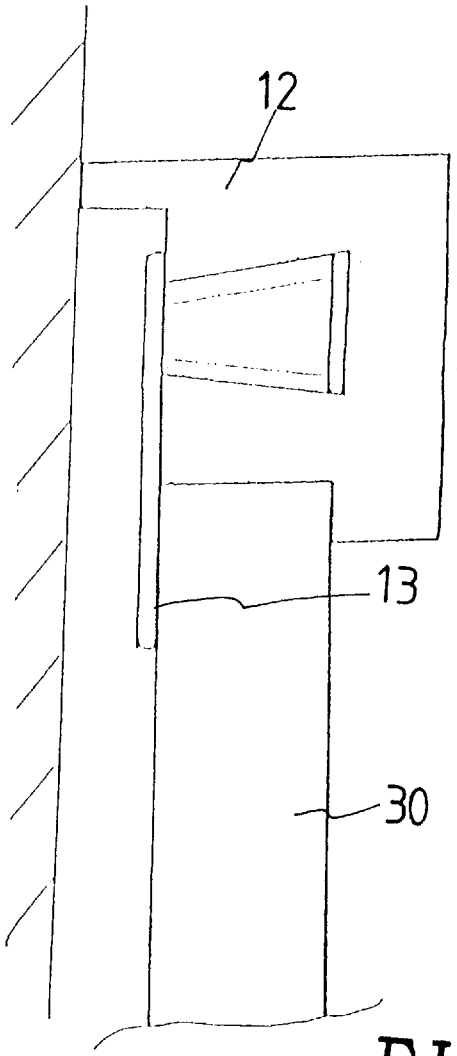
FIG. 8 is an illustrative view to illustrate a gap defined between the wall and the photo receiving device.

Referring to FIG. 8, when hanging the photo receiving device on a wall, a gap is defined between the board 30 and the wall so that dirt will not adhered to a rear side of the board 30.

Figure 4:
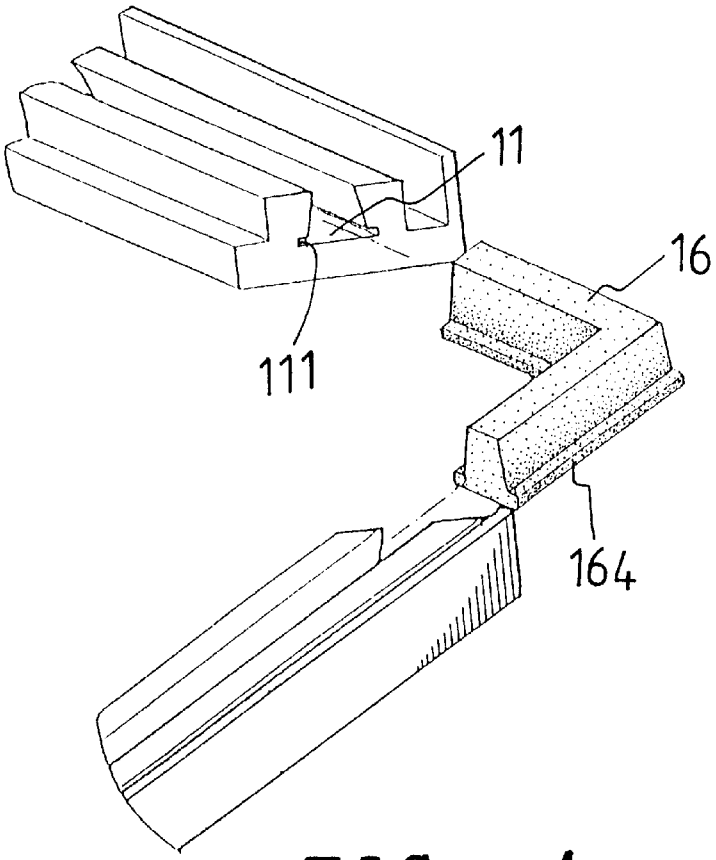
FIG. 4 is an illustrative view to show another embodiment of the corner member and the two adjacent side rails of the present invention.

Referring to FIG. 4, in order to have a better engagement function between the corner members 16 and the dove-tailed grooves 11, each dove-tailed groove 11 has two lateral slits 111 and each corner member 16 has two lateral lips 164 to be received in the corresponding lateral slits 111 to reach a secure engagement therebetween.

Figure 5:
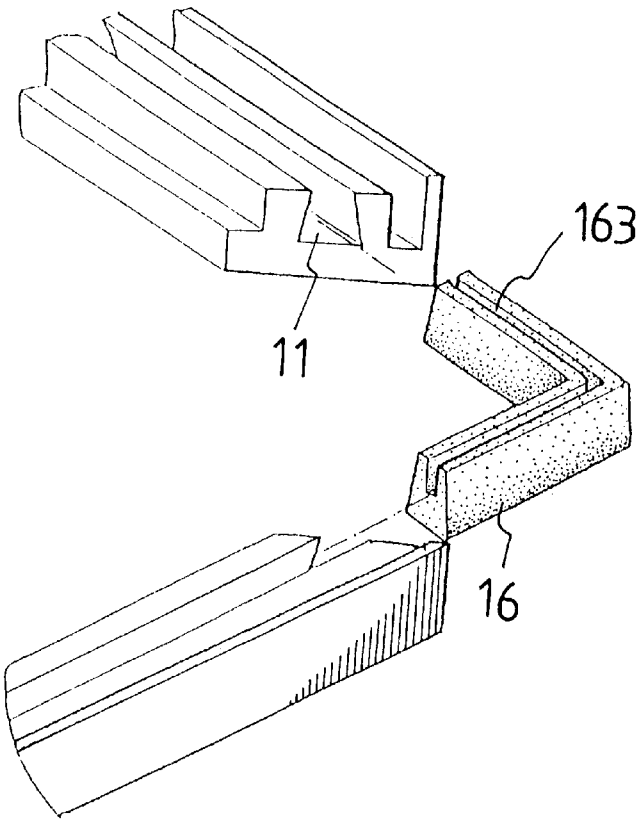
FIG. 5 is an illustrative view to show yet another embodiment of the corner member and the two adjacent side rails of the present invention.

Referring to FIG. 5, each of the corner members 16 may also have a slit 163 defined through an upper surface of the first portion 161 and the second portion 162 thereof so as to provide a suitable flexibility when receiving the corner members 16 into the dove-tailed grooves 11.

Figure 7:
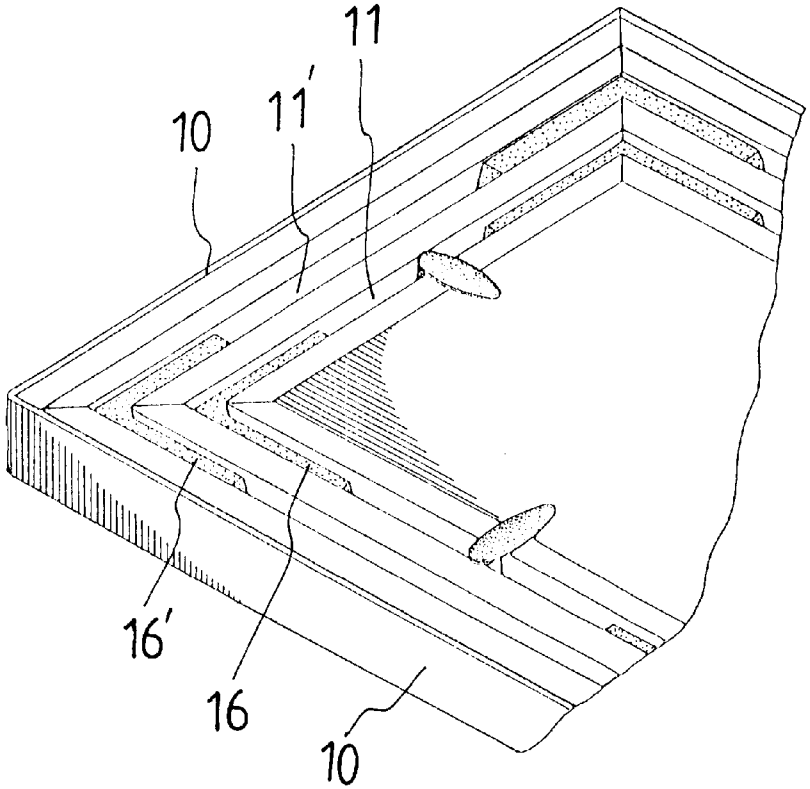
FIG. 7 is a perspective view to show a partial portion of the device connected by the two corner members as shown in FIG. 6.
Figure 6:
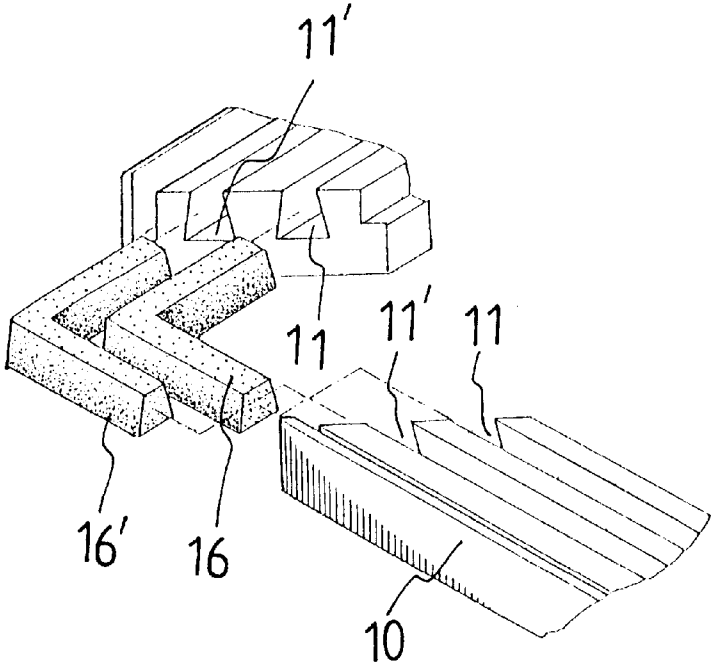
FIG. 6 is an illustrative view to show a further embodiment including two corner members and the two adjacent side rails of the present invention.

FIGS. 6 and 7 illustrate yet another embodiment of the photo receiving device wherein each of the side rails 10 has two dove-tailed grooves 11, 11' so that every two adjacent side rails 10 are connected together by two corner members 16, 16' so as to have a secure engagement between the two adjacent side rails 10.

Figure 9:
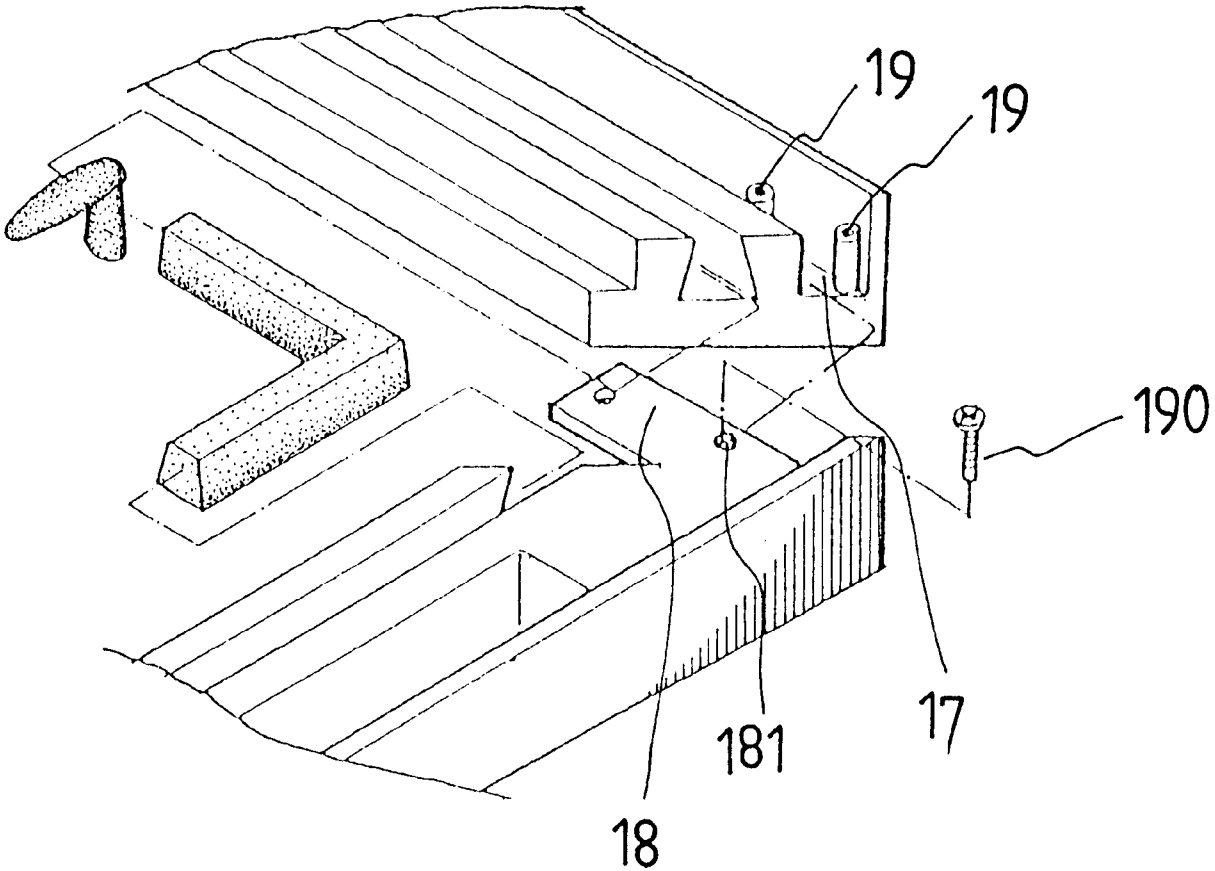
FIG. 9 is an illustrative view to show another embodiment of the two adjacent side rails of the present invention.

Referring to FIG. 9, when receiving a large picture for example, each of the bottoms defining the dove-tailed grooves 11 has two threaded rods 19 extending from one of two ends thereof, and the other end of each of the bottoms has an extending board 18 with two apertures 181 defined therethrough so that each extending board 18 is mounted on the threaded rods 19 on the adjacent side rail 10 and connected by bolts 190.

While we have shown and described various embodiments in accordance with the present invention, it should be clear to those skilled in the art that further embodiments may be made without departing from the scope and spirit of the present invention.

What is claimed is:

1. A photo receiving device comprising:

four side rails each having a dove-tailed groove defined longitudinally therein and a flange extending from an inner side thereof;

four corner members each having a first portion and a second portion which extends perpendicularly to the first portion, adjacent side rails being connected by a corner member, each of said first portion and said second portion being sized to be received in adjacent dove-tailed grooves of said adjacent side rails;

a plurality of pressing members each having an elliptically-shaped shank and a pressing portion which extends perpendicularly from said elliptically-shaped shank corresponding thereto and is adapted to press a board mounted to said four flanges of said four side rails, each of said elliptically-shaped shanks of said pressing members being movably and rotatably received within said dove-tailed grooves of said side rails, and a hanger having an elliptically-shaped shank and a ring member extending perpendicularly from said elliptically-shaped shank of said hanger, said elliptically-shaped shank being movably and rotatably received in one of said dove-tailed grooves.

2. The photo receiving device as claimed in claim 1, wherein said elliptically-shaped shanks of each of said pressing members and said elliptically-shaped shank of said hanger each have a short axis which is shorter than a maximum width of each of said dove-tailed grooves and a long axis which is longer than said maximum width of each of said dove-tailed grooves.

3. The photo receiving device as claimed in claim 1, wherein each of said side rails has a passage defined in parallel with said dove-tailed groove corresponding thereto and located in an outer side thereof, each of said passages being defined by a peripheral side defining said dove-tailed groove, an outer wall and a bottom connected between said peripheral side and said outer wall, each of said bottoms defining said dove-tailed grooves having two threaded rods extending from one of two ends thereof, and the other end of each of said bottoms having an extending board with two apertures defined therethrough so that each extending board is mounted on said threaded rods on said adjacent side rail and connected by bolts.

4. The photo receiving device as claimed in claim 1, wherein each of said outer walls extends perpendicularly to said side rail corresponding thereto.

5. The photo receiving device as claimed in claim 3 or 4, wherein each of said outer walls extends beyond said peripheral side defining said dove-tailed groove.

6. The photo receiving device as claimed in claim 1, wherein each of said corner members has a slit defined through an upper surface of said first portion and said second portion thereof.

* * * * *